United States Patent [19]

Schoenhard

[11] Patent Number: 4,703,867

[45] Date of Patent: Nov. 3, 1987

[54] OIL FILLER FUNNEL AND CAP

[75] Inventor: James D. Schoenhard, Morrison, Ill.

[73] Assignee: International Technology, Inc., Morrison, Ill.

[21] Appl. No.: 869,346

[22] Filed: Jun. 2, 1986

[51] Int. Cl.[4] ..... B65D 25/00

[52] U.S. Cl. ..... 220/85 F; 220/86 R; 141/98

[58] Field of Search ..... 141/98, 331–345, 141/364, 392; 220/85 R, 85 F, 85 SP, 85 S, 86 R

[56] References Cited

U.S. PATENT DOCUMENTS 1,510,631 10/1924 Nutry ..... 141/340
2,811,181 10/1957 Correll ..... 141/340
3,934,623 1/1976 Hays ..... 141/364
4,112,984 9/1978 Gugua et al. ..... 141/98

*Primary Examiner*—Houston S. Bell, Jr.
*Attorney, Agent, or Firm*—John R. Crossan

[57] ABSTRACT

An oil filler funnel and cap are adapted for permanent mounting upon an engine to connect to the usual oil filler passage. The oil filler funnel and cap replaces the normal filler cap, by means of a bar and a sealing gasket. A pipe, which can be routed to avoid other engine parts, extends generally gravitationally upwardly to an enlarged funnel form. The top of the funnel is closed by a sealing cap or lid. The funnel is enlarged in cross section, to allow a car owner to easily fill the engine with oil without spilling same and without the use of auxiliary devices.

1 Claim, 3 Drawing Figures

OIL FILLER FUNNEL AND CAP

The present invention relates to accessories for engines, particularly automobile engines, and more particularly to accessories for facilitating replacement of oil into an engine.

It is well known in the art to provide a removable cap upon an inlet oil passage in the cam cover or other part of the engine, from which the oil can flow by gravity into the crank case. Oil typically is poured into the filler opening from a can using a funnel either placed into the filler opening or affixed to the can, to try to direct the oil poured from the can into the filler opening. Often however the filler opening is difficult to reach at close range, being obstructed by other engine components. Handling of a separate funnel of course involves dripping of oil from the funnel after use and in storage.

In summary, the present invention involves providing a permanent oil filler funnel and cap, permanently mounted to the engine about the original oil filler opening. A mounting attachment secures the funnel and cap to the filler opening in the engine, and a pipe extends from the filler opening upwardly to an accessible location. The device opens radially into a large funnel type opening, which then is selectively sealingly closed by a removable cap. The filler funnel and cap are preferably made of injection molded plastic.

Figure 1:
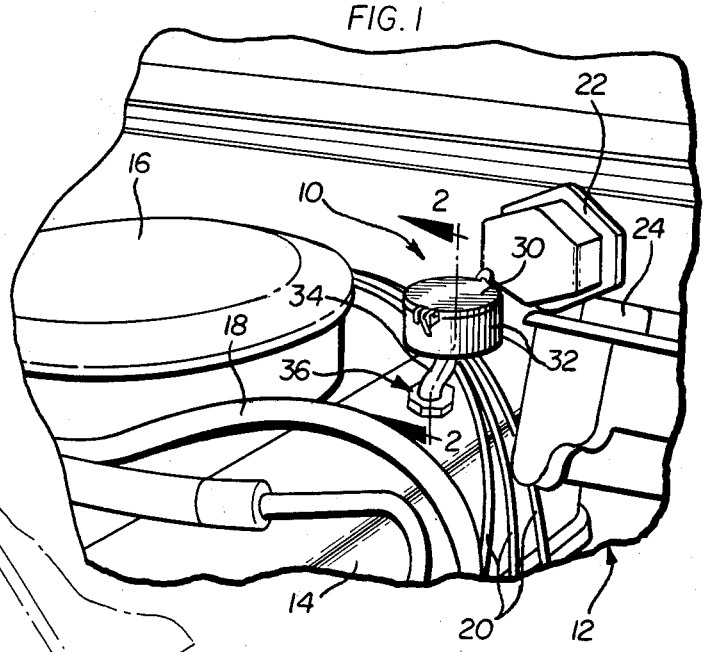
FIG. 1 is a general perspective view of a typical oil filler environment suited for use of the invention.

An oil filler funnel and cap in accordance with one form of the invention is shown in FIG. 1 at 10 in an environment in the engine compartment 12 of an automobile, atop a cam or valve lifter cover 14 and among the air filter 16, hoses 18, wires 20, and other mechanical elements 22 and 24. The oil filler funnel and cap comprises a top closure 30, a collection chamber 32, a pipe 34, and a mount 36 engaging the oil filler passage in the cover 14.

Figure 2:
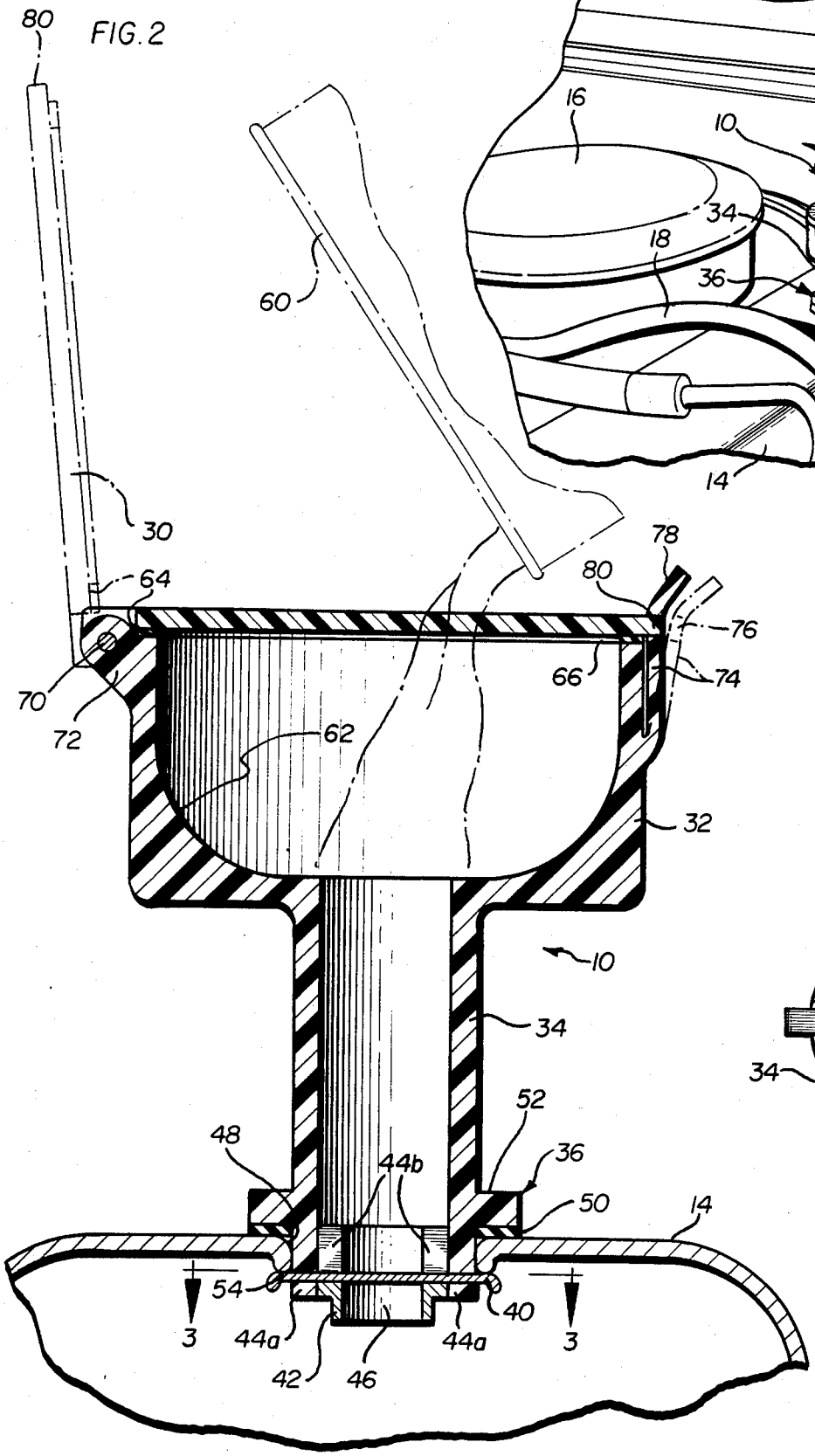
FIG. 2 is a side sectional view through the oil filler funnel and cap of the invention, on line 2—2 of FIG. 1, in its sealed position and, in phantom, in use.
Figure 3:
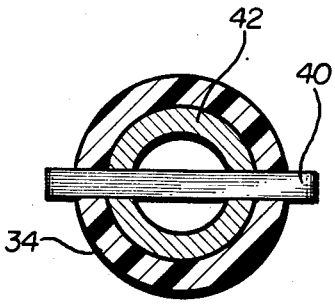
FIG. 3 is a detailed, cross-section view, on line 3—3 of FIG. 2.

FIG. 2 shows the invention in greater detail in cross-section. The mount 36 coupling the oil filler funnel and cap 10 to the cam or valve lifter cover 14 comprises a bar 40 inserted through the lower end of the pipe 34 and held in place by a keeper ring 42. Keeper ring 42 is press-fit inside the pipe 34 and is cemented thereto. Slots 44*a* in the pipe 34 and 44*b* in the keeper ring 42 pass the bar 40 while providing sufficient contact between the rest of the keeper ring 42 and the interior of the pipe 34 to provide a permanent bond by way of the cement or other seal. The center of the ring 42 is apertured as at 46 for passage of oil into the valve lifter cover 14.

The pipe 34 passes downwardly through the usual oil filler passage defined by surfaces 48 in the valve lifter cover 14. A gasket 50 carried downwardly of a flange 52 on the pipe 34 engages the cover 14 to form a vapor and liquid tight seal between the mounting means 36 and the cover 14. The bar 40 is preferably made of spring steel, and is sized to pass into the oil filler hole 48 in the valve lifter cover 14 through the slots (not shown) ordinarily provided for use with a conventional filler cap. The bar 40 then bears against lower surfaces 54 about the opening 48, a selected distance from the gasket 50 and flange 52 to provide the desired sealing effect.

The pipe 34 extends upwardly from the mounting means 36 a distance sufficient to place the top collection chamber 32 a desired distance above the valve lifter cover 14. As shown in FIG. 1, the pipe 34 can be preformed as bent or offset as necessary, or provided in a flexible or adjustable form and length, depending on the particular configuration of the engine compartment 12, to place the collection chamber 32 in a position easily accessible to the car owner without need for additional or separate funnels or other implements.

The collection chamber 32 is formed as an enlarged head upon the pipe 34, having a sufficient horizontal diameter to provide an easy target for pouring oil from a can 60 thereinto. The interior of the chamber 32 of course communicates freely with the interior of the pipe 34 and, through the passage 46 in the keeper ring 42, to the engine crank case. The interior surfaces 62 of the collection chamber are smoothly rounded to pass substantially all the oil into the pipe 34.

The cap 30 is tightly sealed, against loss of vapors from the crankcase, at an upper edge 64 of the collection chamber 32 at a gasket 66 affixed about the periphery of the cap 30. The cap 30 is pivotally mounted to the wall of the collection chamber 32 at a pivot 70 formed in an ear 72 on the side of the collection chamber 32. The pivoting member is conveniently arranged so that the cap 30 is self supporting in the open position, as shown in phantom in FIG. 2, to avoid any need to hold same open manually. Opposite the pivot pin 70 is a retainer clip 74 formed integrally with the side of the collection chamber 32.

The retainer clip 74 has an aperture 76 therein and a camming surface 78. These elements cooperate with a lip 80 on the end of the cap 30 opposite the pivot pin 70, for holding the cap 30 in its closed and sealed position upon the collection chamber 32 when engaged. The cap 30 is released or opened by moving the retainer clip 74 from the solid line position of FIG. 2 to the phantom line position shown, by finger pressure upon the cam surface 78. Downward pressure on the cap 30 engages the lip 80 with the cam surface 78 to deflect the spring clip 74 toward the phantom position, to allow the lip 80 to snap into the retention aperture 76.

While the invention has been shown in one exemplary embodiment, other forms will readily occur to those having ordinary skill in the art. The invention is useful on motorcycles, boats, airplanes, tractors, lawn, and home maintenance and other engines. All such variations in the invention as come within the scope of the appended claims and equivalents thereof are within the scope of the invention.

I claim as my invention:

1. A funnel and cap adated for permanent mounting abount surfaces forming a filler passage in a container for liquid such as an engine or fuel tank, the funnel and cap comprising a mounting means for sealingly engaging said surfaces about said filler passage, a pipe having at least one bend along its length and communicating from said surfaces and passage and extending a selected distance therefrom to conveniently accessible location about said container, a collection chamber carried by said pipe and communicating into said pipe and havine an upper entry portion wider than the pipe for momentarily collecting fluid to be passed gravitationally into said container, and a cap releasably and sealably secured on a pivot joint upon said chamber entry portion, wherein the mounting means comprises a flat bar carried by said pipe and engagable into said filler passage, a sealing surface on said pipe spaced above said bar a distance to sealingly engage said surfaces about said filler passage, and a second passage formed through said mounting means communicating said pipe to said container, whereby to provide a permanent and sealable filler funnel for said container.

* * * * *